US007819290B2

(12) United States Patent
Behar

(10) Patent No.: US 7,819,290 B2
(45) Date of Patent: Oct. 26, 2010

(54) FLEXIBLE PART FORMING AN OUTPUT VALVE AND A RETURN SPRING FOR A DISPENSING DEVICE

(75) Inventor: Alain Behar, Suresnes (FR)

(73) Assignee: Airlessystems, Charleval (FR)

( * ) Notice: Subject to any disclaimer, the term of this patent is extended or adjusted under 35 U.S.C. 154(b) by 494 days.

(21) Appl. No.: 11/666,924

(22) PCT Filed: Oct. 28, 2005

(86) PCT No.: PCT/FR2005/050915

§ 371 (c)(1),
(2), (4) Date: May 3, 2007

(87) PCT Pub. No.: WO2006/048578

PCT Pub. Date: May 11, 2006

(65) Prior Publication Data

US 2008/0110934 A1 May 15, 2008

(30) Foreign Application Priority Data

Nov. 3, 2004 (FR) ..... 04 52512

(51) Int. Cl.
*B65D 37/00* (2006.01)

(52) U.S. Cl. ..... 222/207; 222/340

(58) Field of Classification Search ..... 222/321.9, 222/207, 212, 215, 209, 321.7, 153.13, 340, 222/341, 320, 321.1
See application file for complete search history.

(56) References Cited

U.S. PATENT DOCUMENTS 4,347,953 A * 9/1982 Bauer ..... 222/207
4,807,784 A * 2/1989 Jupin et al. ..... 222/207
4,949,876 A * 8/1990 Schneider ..... 222/209
5,267,673 A * 12/1993 Crosnier et al. ..... 222/321.7
5,544,789 A * 8/1996 Gillingham ..... 222/153.13
5,704,519 A * 1/1998 Crosnier et al. ..... 222/207
6,382,471 B2 * 5/2002 Bonningue et al. ..... 222/321.9
6,971,553 B2 * 12/2005 Brennan et al. ..... 222/207
7,025,233 B2 * 4/2006 Masuda ..... 222/321.9
2006/0163286 A1 * 7/2006 Neerincx ..... 222/207
2007/0131719 A1 * 6/2007 Masuda ..... 222/256

FOREIGN PATENT DOCUMENTS

DE 38 28 811 A1 3/1989
EP 0 213 048 A1 3/1987
FR 2 674 024 A1 9/1992
WO WO 2004/004921 A1 1/2004
WO WO 2004004921 A1 * 1/2004

* cited by examiner

*Primary Examiner*—Kevin P Shaver
*Assistant Examiner*—Daniel R Shearer
(74) *Attorney, Agent, or Firm*—Sughrue Mion, PLLC

(57) ABSTRACT

The present invention relates to a fluid dispenser member comprising a body (1), a pusher (2) axially displaceable between a rest position and a depressed position, the pusher forming a fluid dispenser orifice (24), and a flexible part (3) connecting the body to the pusher. The part forms return spring means (35) urging the pusher towards the rest position. The part also forms the moving member (38) of an outlet valve. The part also comprises support means (33) engaged with the body, and anchor means (37) engaged with the pusher. The support means are surrounded by the anchor means. The part includes an elastically deformable portion (34) that extends between the support means and the anchor means. The elastically deformable portion (34) constitutes both the return spring means (35) and the outlet valve moving member (38).

20 Claims, 3 Drawing Sheets

Figure 1:
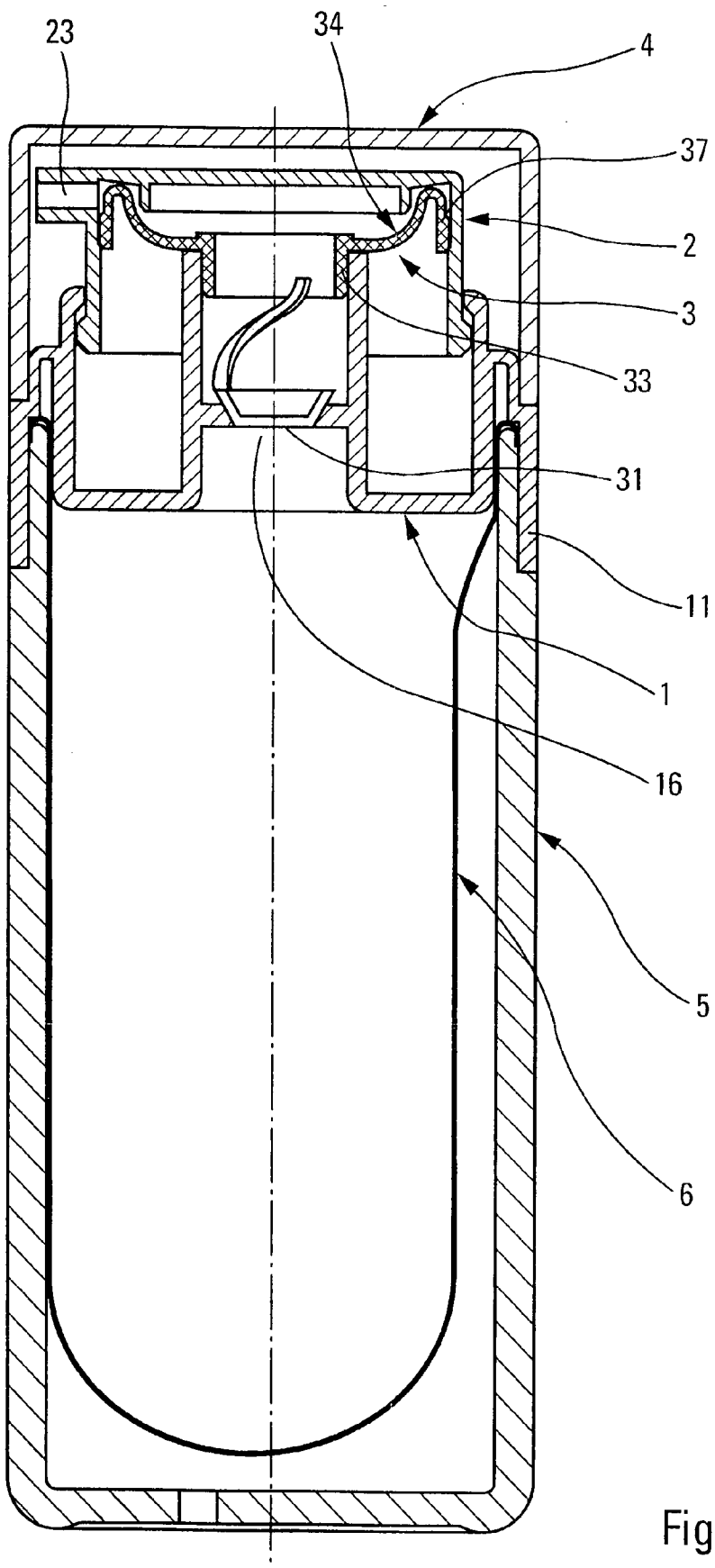

FLEXIBLE PART FORMING AN OUTPUT VALVE AND A RETURN SPRING FOR A DISPENSING DEVICE

The present invention relates to a fluid dispenser member comprising a body for mounting or fastening on a reservoir opening, a pusher that is axially displaceable both towards and away from the body, and a flexible part connecting the body to the pusher. The flexible part forms return spring means urging the pusher towards a rest position. The flexible part also forms the valve member of an outlet valve, which valve member co-operates with an outlet valve seat formed by the pusher. The invention also relates to a fluid dispenser comprising a fluid reservoir and a dispenser member mounted on the reservoir. Such a dispenser member and such a dispenser can be used in particular in the fields of perfumery, cosmetics, or indeed pharmacy.

In the prior art, document FR-2 674 024 discloses a pump comprising a body made integrally with a portion of the reservoir. The pump further comprises a pusher that is axially movable towards and away from the body. The pump also comprises an inner part made of a flexible elastic material. The inner part joins the body to the pusher. More precisely, the pusher forms an inlet tube defining an inlet opening in communication with the reservoir. The inlet tube is disposed in a central axial position. Furthermore, the pusher has a side skirt that extends downwards from a press wall on which pressure can be exerted in order to move the pusher. The peripheral side skirt of the pusher extends in variable manner around the inlet tube. The inner part is mounted on the inlet tube and forms the valve member of an inlet valve, which member bears selectively in leaktight manner against the inlet opening formed by the tube. Furthermore, the part also forms return spring means in the form of a tubular sleeve that is elastically deformable in elongation. That return sleeve extends around the inlet tube inside the peripheral skirt of the pusher. The inner part also forms an anchor stub engaged with the pusher, more particularly at the bottom end of the side skirt. The spring sleeve thus connects said anchor stub to the portion of the part that forms the inlet valve. Finally, the inner part forms a deformable annular lip that bears in leaktight manner around the outlet valve seat. The annular lip thus acts as the valve member of an outlet valve for the fluid under pressure inside the chamber formed between the pusher and the inner part. The lip forming the outlet valve moving member extends from the anchor stub in substantially concentric manner around the spring sleeve. Thus, the return spring function and the outlet valve moving member function are performed by two distinct portions of the inner part. This naturally makes the inner part more complicated to manufacture. In addition, it is not easy to put the pusher into place on the inner part, and more particularly to put the elastically deformable lip into place around its seat.

An object of the present invention is to remedy the above-mentioned drawbacks of the prior art by defining a dispenser member in which the flexible inner part is easier to manufacture and to mount.

To achieve these objects, the present invention provides a fluid dispenser member comprising: a body for fastening on a reservoir opening, the body defining a fluid inlet causing the reservoir to communicate with the inside of the body; a pusher that is axially displaceable both towards and away from the body between a rest position and a depressed position, the pusher forming a fluid dispenser orifice; and a flexible part connecting the body to the pusher, the part forming return spring means urging the pusher towards the rest position, the part forming an outlet valve moving member co-operating with a seat formed by the pusher, the part having support means engaged with the body to mount the part securely on the body, the part having anchor means engaged with the pusher to secure the part to the pusher, the support means being surrounded by the anchor means, and the part including an elastically deformable portion connecting the support means to the anchor means; the fluid dispenser member being characterized in that the elastically deformable portion constitutes both the return spring means and the outlet valve moving member. Unlike the above-mentioned prior art, the spring function and the outlet valve moving member function are both performed by a single portion of the flexible part. The flexible part of the present invention thus omits a distinct sealing lip performing the outlet valve moving member function.

The dispenser member of the present invention presents a design or architecture that is substantially similar to that of the above-mentioned prior art document, i.e. the flexible part presents a smaller diameter at its connection to the body than at its connection to the pusher, which amounts to saying that the support means are surrounded by the anchor means, even if the support means and the anchor means are axially offset.

In an advantageous embodiment, the outlet valve moving member is radially deformable outwards from its seat between the rest position and the depressed position. Preferably, the outlet valve moving member and its seat are annular in shape, the outlet valve moving member surrounding the seat from the outside.

In a practical embodiment, the return spring means comprise an annular ring in the form of an upside-down dome.

According to another aspect, the deformable portion forms a corolla shape that extends outwards around the support means towards the anchor means, the corolla shape presenting a section in the form of a siphon or of a prone swan neck. Advantageously, the corolla shape has an inner first section that extends radially outwards, being upwardly curved, and an outer second section connected to the outside of the first section and extending radially outwards forming a downwardly-directed bend. Preferably, the outlet valve moving member is formed at the junction between the first and second sections. It can thus be said that the support means are formed inside the first section and the anchor means are formed outside the second section.

According to another characteristic of the invention, the part also forms an inlet valve moving member elastically urged by resilient tabs against an inlet valve seat. Thus, as in the above-mentioned prior art document, the flexible part constitutes simultaneously the moving members of the inlet valve and of the outlet valve and also the return spring means.

The invention also provides a fluid dispenser comprising a fluid reservoir and a dispenser member as defined above.

The invention is described more fully below with reference to the accompanying drawings giving an embodiment of the invention by way of non-limiting example.

Figure 2:
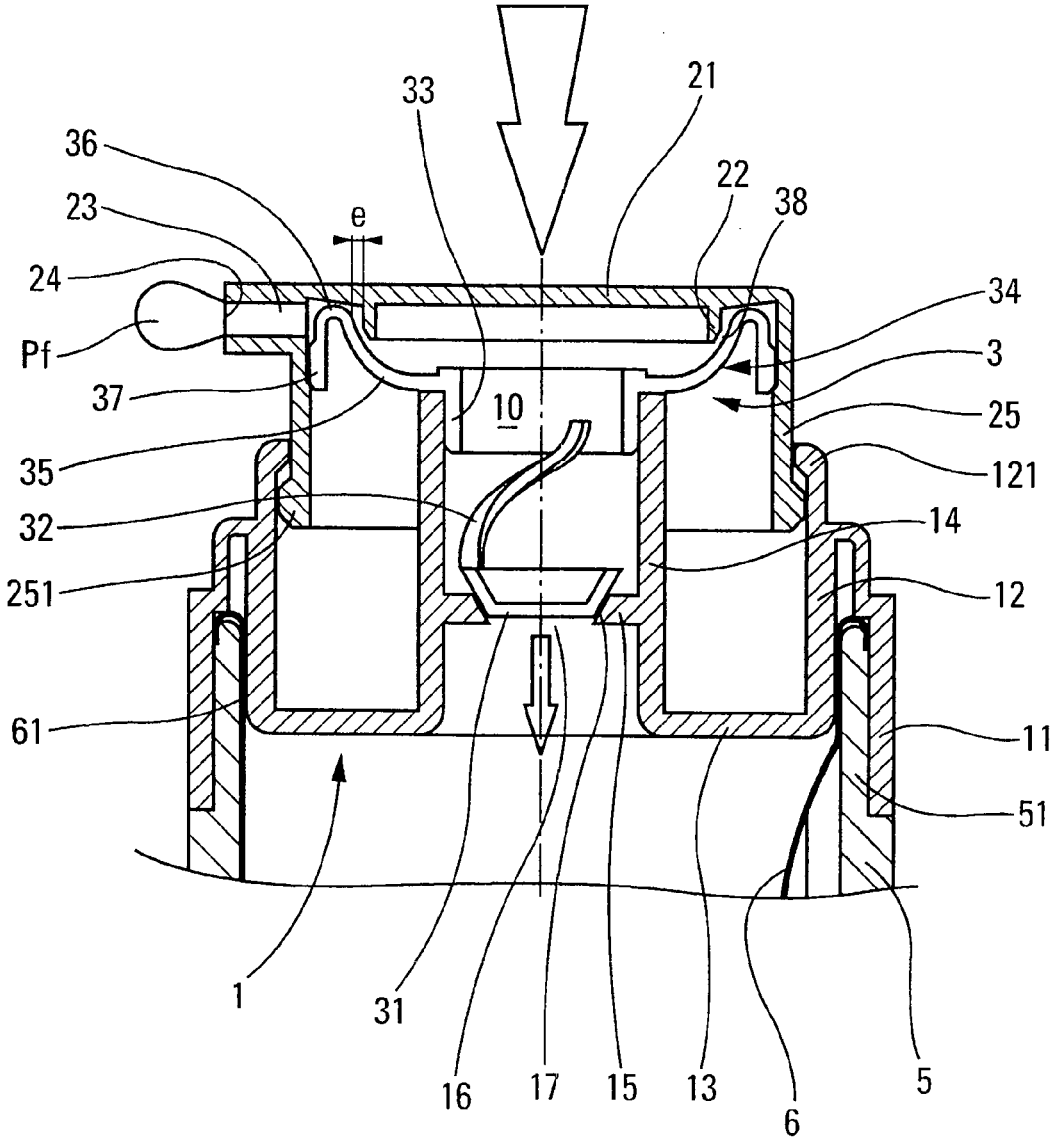
Figure 3:
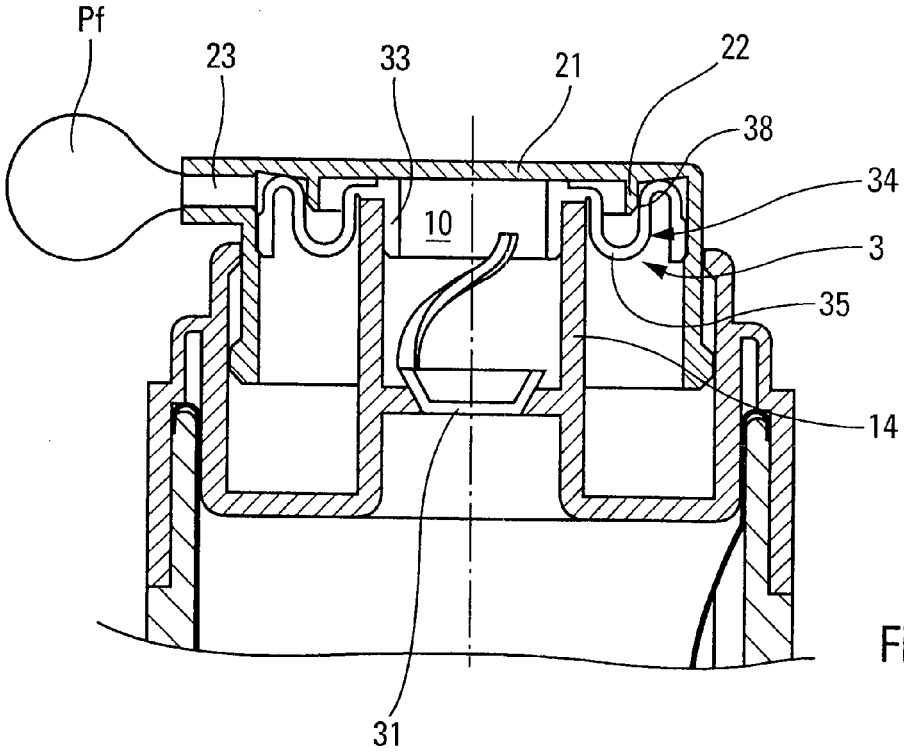
Figure 4:
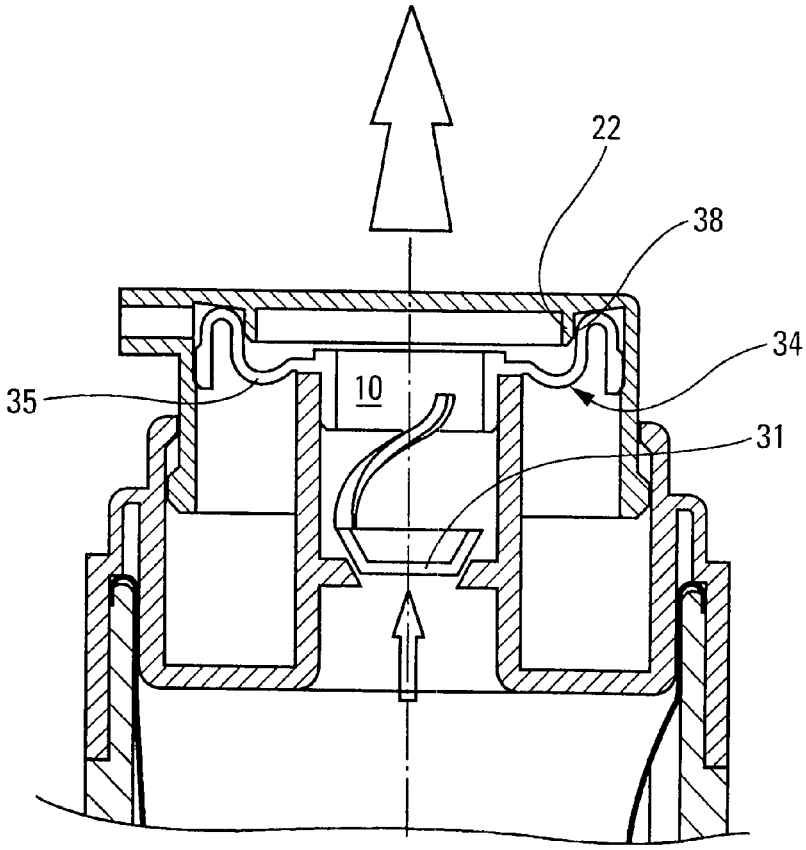

In the figures:

FIG. 1 is a vertical cross-section view through a fluid dispenser including a dispenser member constituting an embodiment of the invention; and FIGS. 2, 3, and 4 are vertical cross-section views on a larger scale showing the dispenser member of FIG. 1, during different stages of actuation.

With reference to FIG. 1, there can be a fluid dispenser that is more particularly adapted to dispensing fluids that are pasty or viscous, such as creams. Consequently, it is used more particularly for dispensing a cosmetic. Nevertheless, other types of fluid can also be dispensed such as gels, and pastes in other fields, including in the food industry.

The dispenser comprises a reservoir which in this example is constituted by an inner flexible pouch 6 and an outer shell 5, which is preferably rigid. The outer shell 5 defines a neck 51 and the flexible pouch 6 defines an opening 61. By way of example, the opening 61 can be folded back over the neck 51, as can be seen in the figures. The flexible pouch 6 constitutes a fluid reservoir of volume that varies as the fluid is extracted from the pouch. It can thus be referred to as an "airless" reservoir with no air intake, in which the fluid is protected from outside air. Naturally, it is possible to imagine other types of reservoir associated with the dispenser member of the invention. In particular, it is possible to use a reservoir comprising a cylinder with a follower piston mounted slidably inside the cylinder. That also would constitute a reservoir of the airless type. It is also possible to use reservoirs that are more conventional, presenting a volume that is constant, such as flask made of glass, of plastics material, or of metal. Under such circumstances, the dispenser member of the invention needs to be provided with a dip tube.

The dispenser member of the invention is mounted on the opening 61 of the pouch 6, which here coincides with the neck 51 of the rigid outer shell 5. The dispenser member of the invention comprises three component elements, namely: a body 1, a pusher 2, and a flexible part 3. Optionally, the dispenser member may include a protective cap 4 that covers the pushbutton and a portion of the body. The body 1, the pusher 2, and the protective cap 4 can be made by injection molding a relatively rigid plastics material. The flexible part 3 may be made by injection molding a plastics material that is more flexible, such as an elastomer, for example. Thus, the flexible part 3 presents characteristics of elastic deformability at at least certain locations of its extent. In other words, certain portions of the flexible part may be rigid, whereas other portions may be elastically deformable. The deformability characteristic may be imparted by the materials used to make the flexible part, or else by its configuration, its architecture, or its wall thickness.

Reference is now made more particularly to FIG. 2 for explaining in detail the structure of the dispenser member of the invention. The dispenser member is shown in FIG. 1 in the rest position, i.e. with the pusher 2 in its position furthest away from the body, whereas in FIG. 2 the dispenser member is shown while it is being actuated, specifically during a stage of starting to dispense the fluid Pf.

The body 1 is preferably made as a single block. Nevertheless, it is not impossible for it to be made up of two, three, or four separate parts fitted together. The body 1 in this example comprises an outer fastener ring 11 engaged around the neck 51 of the rigid shell 5. The ring 11 may be provided with any suitable connection means enabling the body 1 to be fastened firmly and preferably permanently to the rigid shell 5, or more generally to the fluid reservoir. This outer fastener ring 11 is connected to an inner bushing 12 that, in its bottom portion, penetrates inside the neck 51. Advantageously, the bushing 12 wedges the opening 61 of the flexible pouch 6 against the inside wall of the neck 51 of the rigid outer shell 5. The opening 61 may even be wedged between the neck 61 and the outer fastener ring 11. This guarantees perfect sealing between the flexible pouch 6 and the body 1. At its top free end, the inner bushing 12 forms a reentrant abutment profile 121 that performs a function explained below. At its bottom end, the bushing 12 is extended by a substantially horizontal annular web 13 that closes the opening 61 of the pouch 6. This annular web 13 acts as a roof or reentrant shoulder for the fluid reservoir. At its inner periphery, the web 13 is extended upwards in the form of a substantially cylindrical tube 14 that is terminated by a free top end. The tube 14 is provided internally with an inlet collar 15 that defines both a fluid inlet 16 and an inlet valve seat 17. It can be said that the fluid reservoir extends into the inside of the tube 14 as far as the inlet collar 15. In its top portion, the tube 14 forms a pump chamber cylinder. The body 1 may present perfect circular symmetry about a vertical axis. The fastener ring 11, the bushing 12, and the tube 14 may be of circularly cylindrical shape sharing a common axis X. In other words, the ring 11, the bushing 12, and the tube 14 extend coaxially: the bushing 12 is inside the ring 11, and the tube 14 extends inside the bushing 12.

The pusher 2 has a press surface 21 on which one or more fingers of a hand can be pressed in order to move it down-and-up along the axis relative to the body 1. The press surface 21 extends substantially perpendicularly to the axis X. At its outer periphery, the press surface 21 is extended downwards by a peripheral side skirt 25 having its free end defining an abutment bead 251 for co-operating with the reentrant abutment profile 121. The skirt 25 presents an outside diameter that is smaller than the inside diameter of the bushing 12. The pusher 2 also forms a dispenser endpiece defining internally an outlet duct 23 that opens out via a dispenser orifice 24. The user can take the dispensed fluid from the dispenser orifice 24. In the embodiment shown in the drawings, the endpiece 23 extends radially or laterally outwards. Nevertheless, it is possible to devise a dispenser endpiece that extends vertically either axially or off-center. According to the invention, the pusher 2 also defines a seat rim 22 that extends downwards from the press surface 21. The seat rim 22 is of substantially cylindrical annular shape with its axis likewise coinciding with the axis X. The seat rim 22 presents a diameter that is smaller than that of the side skirt 25, but greater than the outside diameter of the tube 14. The pusher 2 is mounted on the body 1 with its skirt 25 engaged inside the bushing 12. The pusher 2 is prevented from disengaging from the body 1, because of the engagement between the bead 251 and the profile 121.

According to the invention, the flexible part 3 is preferably made as a single piece. The part 3 comprises a fastener sleeve 33 engaged inside the tube 14 from its free top end. The sleeve 33 can be engaged as a force-fit inside the tube 14. Nevertheless, it is possible to provide snap-fastening means to assist in fastening the sleeve 33 to the tube 14. The sleeve 33 projects axially beyond the free end of the tube 14. The sleeve is extended radially outwards by an elastically deformable portion 34 similar to the corolla of a flower that presents a configuration in cross-section that is substantially in the shape of a prone swan neck or of a siphon. More precisely, the elastically deformable portion or corolla comprises an inner first section 35 similar to an annular ring curved upwards in the form of an upside-down dome and that is then extended by an outer second section 36 that is curved downwards. The sections 35 and 36 meet at a portion that is substantially cylindrical. At this location, the elastically deformable portion 34 forms the moving member 38 of an outlet valve that is to come selectively into leaktight contact against the outer wall of the seat rim 22 formed on the pusher 2. It can also be said that the seat rim 33 forms an outlet valve seat for the outlet valve moving member 38 as constituted by the elastically deformable portion 34 of the part 3. At its outer free end, the elastically deformable portion forms an anchor ring 37 tightly engaged in leaktight manner inside the side skirt 25. This ring 37 performs a function of anchoring the flexible part 3 inside the pusher 2.

It can thus be seen in the figures that the outer, second section 36 extends outside the seat rim 22, but inside the skirt 25. The inner, first section 35, extends substantially between the seat rim 22 and the tube 14. The configuration of the elastically deformable portion 34 in the form of a prone swan neck or a siphon gives it a deformability characteristic that enables the outlet valve moving member 38 to separate from its seat 22 by moving radially outwards. In particular, in FIG. 2, it can be seen at 38 that the elastically deformable portion is spaced apart from the seat 22 by a distance e that defines an annular gap through which the fluid can escape towards the dispenser duct 23.

Optionally, the flexible part 3 may also form the moving member 31 of an inlet valve selectively in leaktight engagement with the inlet valve seat 17 formed by the body 1. Advantageously, the inlet valve moving member 31 is urged resiliently against its seat by resilient tabs 32 formed integrally with the flexible part 3. These resilient tabs 32 connect the inlet valve moving member 31 to the support sleeve 33. The inlet valve moving member 31 may be in the form of a cup or a saucer suitable for engaging in leaktight manner inside the seat 17, thus closing the fluid inlet 16.

The body 1, the pusher 2, and the flexible part 3 together form a pump chamber 10 that is closed at its inlet by the inlet valve and at its outlet by the outlet valve. In the configuration shown in FIG. 1, the dispenser member is in the rest position. This rest position is determined by the rest position of the flexible part 3. The elastically deformable portion 34, and more particularly its inner first section 35, acts as return spring means enabling the pusher 2 to be urged towards its rest position relative to the body 1. This rest position corresponds to the pusher 2 being in its position that is furthest from the body 1. This rest position may also be defined by the bead 251 coming into abutment against the underside of the profile 121. Under such circumstances, the rest position does not correspond to the rest position of the flexible part 3, since that part remains continuously under stress. Nevertheless, in the rest position of the dispenser member, the pump chamber 10 defines a maximum working volume, with its inlet valve closed and its outlet valve likewise closed. The moving member 31 is pressed against its seat 17 while the moving member 38 is pressed in leaktight contact against its seat 22.

By pressing on the surface 21 of the pusher 2, it is moved axially downwards towards the body 1. This axial displacement guided by the bushing 12 has the effect of deforming the elastically deformable portion 34, more particularly in its inner, first section 35. Nevertheless, the outer, second section 36 also deforms a little in order to allow the outlet valve moving member 38 to separate from its seat 22, as can be seen in FIG. 2. Thus, the axial displacement of the pusher 2 has the effect of deforming the inner first section 34 so as to further emphasize its upside-down dome shape. Depressing the pusher 2 has the effect of pressing the inlet valve moving member 31 against its seat 17 and of reducing the working volume of the chamber 10, thereby exerting pressure on the outlet valve moving member 38 so that it separates from its seat 22. In FIG. 2, it can be seen that the valve member 38 is spaced apart from its seat 22 by a distance e. Consequently, the fluid put under pressure inside the chamber 10 is delivered through the open outlet valve towards the dispenser duct 23 and the dispenser orifice 24, from which it can be taken by the user. The fully depressed position is reached when the abutment wall 21 comes into abutment against the support sleeve 33. This is shown in FIG. 3. The first section 35 then presents a configuration in the form of an annular trough. The entire metered quantity of fluid Pf is then dispensed. As soon as the pressure inside the chamber 10 drops below a predetermined threshold, the outlet valve closes. By releasing pressure on the pusher 2, as can be seen in FIG. 4, the pusher is urged upwards towards its rest position by the elastic memory of the elastically deformable portion 34 tending to return towards its rest or starting position. This return to the rest position has the effect of increasing the volume of the chamber 10 and thus of creating suction, which has the consequence of opening the inlet valve to enable fluid to be sucked from the flexible pouch into the chamber 10 as its volume increases.

It is the particularly advantageous configuration of the elastically deformable part 35 that makes it possible simultaneously to perform the function of a return spring and the function of a moving member for the outlet valve of the pump.

An inlet valve moving member that is much more simple could readily be devised, e.g. in the form of elastically deformable disk situated inside the support sleeve 33.

The invention claimed is:

1. A fluid dispenser member comprising:

a body (1) for fastening on a reservoir opening (61), the body defining a fluid inlet (16) causing the reservoir to communicate with the inside of the body;

a pusher (2) that is axially displaceable towards and away from the body between a rest position and a depressed position, the pusher forming a fluid dispenser orifice (24); and a flexible part (3) connecting the body to the pusher, the flexible part forming return spring means (35) urging the pusher towards the rest position, the flexible part forming an outlet valve moving member (38) co-operating with a seat (22) formed by the pusher, the flexible part having support means (33) engaged with the body to mount the flexible part securely on the body, the flexible part having anchor means (37) engaged with the pusher to secure the flexible part to the pusher, the support means being surrounded by the anchor means, and the flexible part including an elastically deformable portion (34) connecting the support means to the anchor means;

wherein the elastically deformable portion (34) constitutes both the return spring means (35) and the outlet valve moving member (38); and wherein the outlet valve moving member and its seat are annular in shape, the outlet valve moving member surrounding the seat from the outside.

2. A dispenser member according to claim 1, in which the outlet valve moving member is radially deformable outwards from its seat between the rest position and the depressed position.

3. A dispenser member according to claim 1, in which the return spring means comprise an annular ring (35) in the form of an upside-down dome.

4. A dispenser member according to claim 1, in which the deformable portion forms a corolla shape (34) that extends outwards around the support means towards the anchor means, the corolla shape presenting a section in the form of a siphon or of a prone swan neck.

5. A dispenser member according to claim 4, in which the corolla shape has an inner first section (35) that extends radially outwards, being upwardly curved, and an outer second section (36) connected to the outside of the first section and extending radially outwards forming a downwardly-directed bend.

6. A dispenser member according to claim 5, in which the outlet valve moving member is formed at the junction between the first and second sections.

7. A dispenser member according to claim 5, in which the support means are formed inside the first section and the anchor means are formed outside the second section.

8. A dispenser member according to claim 1, in which the flexible part also forms an inlet valve moving member (31) elastically urged by resilient tabs (32) against an inlet valve seat (17).

9. A fluid dispenser comprising a fluid reservoir (6) and a dispenser member according to claim 1.

10. A fluid dispenser comprising:

a reservoir having an opening;

a dispenser member comprising:

a body fastened to the reservoir opening, the body defining a fluid inlet communicating the reservoir to an inside of the body;

a pusher axially displaceable towards and away from the body between a rest position and a depressed position, the pusher forming a fluid dispenser orifice, the pusher further comprising a seat; and a flexible part connecting the body to the pusher, the flexible part comprising a fastener engaged with the body that secures the flexible part to the body, the flexible part comprising an anchor engaged with the pusher that secures the flexible part to the pusher, the fastener surrounded by the anchor, and the flexible part comprising an elastically deformable portion that connects the fastener to the anchor means, the elastically deformable portion constituting both a return spring urging the pusher towards the rest position and an outlet valve moving member co-operating with the seat of the pusher; and the elastically deformable portion is in a form of a prone swan neck such that the outlet valve moving member separates from the seat of the pusher by moving radially outwards.

11. The fluid dispenser according to claim 10, wherein the outlet valve moving member is a segment of the return spring and urges the pusher towards the rest position.

12. A fluid dispenser member comprising:

a body for fastening on a reservoir opening, the body defining a fluid inlet causing the reservoir to communicate with the inside of the body;

a pusher that is axially displaceable towards and away from the body between a rest position and a depressed position, the pusher forming a fluid dispenser orifice; and a flexible part connecting the body to the pusher, the flexible part forming return spring means urging the pusher towards the rest position, the flexible part forming an outlet valve moving member co-operating with a seat formed by the pusher, the flexible part having support means engaged with the body to mount the flexible part securely on the body, the flexible part having anchor means engaged with the pusher to secure the flexible part to the pusher, the support means being surrounded by the anchor means, and the flexible part including an elastically deformable portion connecting the support means to the anchor means;

wherein the elastically deformable portion constitutes both the return spring means and the outlet valve moving member; and wherein the outlet valve moving member is radially deformable outwards from its seat between the rest position and the depressed position.

13. The dispenser member according to claim 12, wherein the return spring means comprise an annular ring in the form of an upside-down dome.

14. The dispenser member according to claim 12, wherein the deformable portion forms a corolla shape that extends outwards around the support means towards the anchor means, the corolla shape presenting a section in the form of a siphon or of a prone swan neck.

15. The dispenser member according to claim 14, wherein the corolla shape has an inner first section that extends radially outwards, being upwardly curved, and an outer second section connected to the outside of the first section and extending radially outwards forming a downwardly-directed bend.

16. The dispenser member according to claim 15, wherein the outlet valve moving member is formed at the junction between the first and second sections.

17. The dispenser member according to claim 15, wherein the support means are formed inside the first section and the anchor means are formed outside the second section.

18. The dispenser member according to claim 12, wherein the flexible part also forms an inlet valve moving member elastically urged by resilient tabs against an inlet valve seat.

19. A fluid dispenser comprising a fluid reservoir and a dispenser member according to claim 12.

20. A dispenser member according to claim 12, in which the outlet valve moving member and its seat are annular in shape, the outlet valve moving member surrounding the seat from the outside.

* * * * *